US010775072B2

(12) United States Patent
Duchet et al.

(10) Patent No.: US 10,775,072 B2
(45) Date of Patent: Sep. 15, 2020

(54) COVER CHANNEL, COVER FRAME, INSULATING PANEL, AIR HANDLING UNIT AND METHOD FOR MANUFACTURING A COVER CHANNEL

(71) Applicants: Carrier Corporation, Palm Beach Gardens, FL (US); Samuel Duchet, Lyons (FR)

(72) Inventors: Samuel Duchet, Lyons (FR); Marc Serra, Andert et Condon (FR); Thomas Carton, Eloise (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/080,950

(22) PCT Filed: Mar. 3, 2016

(86) PCT No.: PCT/IB2016/000370
§ 371 (c)(1),
(2) Date: Aug. 29, 2018

(87) PCT Pub. No.: WO2017/149342
PCT Pub. Date: Sep. 8, 2017

(65) Prior Publication Data
US 2019/0063781 A1 Feb. 28, 2019

(51) Int. Cl.
*F24F 13/20* (2006.01)
*F24F 13/02* (2006.01)
(Continued)

(52) U.S. Cl.
CPC ..... *F24F 13/0263* (2013.01); *E04B 1/80* (2013.01); *E04C 2/243* (2013.01); *E04C 2/246* (2013.01);
(Continued)

(58) Field of Classification Search
CPC . Y10T 428/24198; E04C 2/292; E04C 2/296; F24F 13/20
See application file for complete search history.

(56) References Cited

U.S. PATENT DOCUMENTS 3,310,926 A 3/1967 Brandreth et al.
3,372,520 A 3/1968 Hensel
(Continued)

FOREIGN PATENT DOCUMENTS

CN 203585529 U 5/2014
DE 202007018698 U1 3/2009
(Continued)

OTHER PUBLICATIONS

Cummings, James B., "Problems Related to Air Handler Leakage", Ashrae Journal, Jan. 2008, 7 pages.
(Continued)

*Primary Examiner* — Alexander S Thomas
(74) *Attorney, Agent, or Firm* — Cantor Colburn LLP

(57) ABSTRACT

This cover channel (41) is configured for covering, at least in part, an edge (29) of an insulating panel (4A) with two outer walls (21, 23), the cover channel comprising an elongated body (43) comprising a cover portion (45), two outer portions (51), protruding respectively from an edge of said cover portion in a substantially perpendicular direction relative to the cover portion, and two clamping portions (53), each protruding from the cover portion alongside one of the outer portions for clamping a rim portion (31, 33) of one of the two outer walls. According to the invention, the cover channel (41) comprises a sealing gasket (63) provided along the elongated body (43), resting against the cover portion (45) within at least one of the clamping gaps (55).

13 Claims, 4 Drawing Sheets

(51) Int. Cl.

| | |
|---|---|
| ***E04C 2/292*** | (2006.01) |
| ***E04C 2/24*** | (2006.01) |
| ***E04C 2/38*** | (2006.01) |
| ***E04B 1/80*** | (2006.01) |
| *E04C 2/296* | (2006.01) |

(52) U.S. Cl.

CPC ..... *E04C 2/292* (2013.01); *E04C 2/38* (2013.01); *E04C 2/384* (2013.01); *E04C 2/388* (2013.01); *F24F 13/0281* (2013.01); *F24F 13/20* (2013.01); *E04C 2/296* (2013.01); *Y10T 428/24198* (2015.01)

(56) References Cited

U.S. PATENT DOCUMENTS

| | | | |
|---|---|---|---|
| 3,630,549 | A | 12/1971 | Grimm |
| 4,466,641 | A | 8/1984 | Heilman et al. |
| 4,486,994 | A | 12/1984 | Fisher et al. |
| 4,508,376 | A | 4/1985 | Arnoldt |
| 5,673,947 | A | 10/1997 | De Waal |
| 5,870,868 | A | 2/1999 | Kita et al. |
| 6,213,522 | B1 | 4/2001 | Jacobson et al. |
| 6,497,256 | B1 | 12/2002 | Adams et al. |
| 6,530,191 | B2 | 3/2003 | Ricke et al. |
| 6,530,630 | B2 | 3/2003 | Herbeck et al. |
| 6,676,234 | B2 | 1/2004 | Herbeck et al. |
| 6,974,383 | B2 | 12/2005 | Lewis et al. |
| 7,104,104 | B1 | 9/2006 | Hermanson |
| 7,195,290 | B2 | 3/2007 | Duffy |
| 7,757,510 | B2 | 7/2010 | Rosete et al. |
| 8,182,642 | B2 | 5/2012 | Wellman et al. |
| 8,678,450 | B2 | 3/2014 | Seraphinoff |
| 9,074,788 | B2 | 7/2015 | Duffy |
| 2003/0009969 | A1 | 1/2003 | Herbeck et al. |
| 2004/0149757 | A1 | 8/2004 | Lewis et al. |
| 2014/0048167 | A1 | 2/2014 | Gudenburr et al. |
| 2015/0101697 | A1 | 4/2015 | Duffy |

FOREIGN PATENT DOCUMENTS

| | | | | |
|---|---|---|---|---|
| EP | 1191267 | A1 | 3/2002 | |
| GB | 2168732 | A | 6/1968 | |
| GB | 2269868 | A | 2/1994 | |
| GB | 2523395 | A | 8/2015 | |
| JP | H076670 | B2 | 1/1995 | |
| JP | 2961369 | B1 | 10/1999 | |
| JP | 3715015 | B2 | 11/2005 | |
| KR | 20050095040 | A | 9/2005 | |
| WO | WO-9424493 | A1 * | 10/1994 | ..... E04C 2/292 |
| WO | 0150068 | A1 | 7/2001 | |
| WO | 03006889 | A2 | 1/2003 | |
| WO | 2005024251 | A1 | 3/2005 | |

OTHER PUBLICATIONS

International Search Report and Written Opinion for application PCT/IB2016/000370, dated Nov. 11, 2016, 11 pages.

Withers, Charles et al., "Air Handlers: An Appliance of Airtight Defiance?", Florida Solar Energy Center, ACEEE Summer Study on Energy Efficiency in Building, Aug. 2006, 13 pages.

Chinese Office Action and Search Report for application CN 2016800829227.1, dated Feb. 25, 2020, 8 pages.

* cited by examiner

COVER CHANNEL, COVER FRAME, INSULATING PANEL, AIR HANDLING UNIT AND METHOD FOR MANUFACTURING A COVER CHANNEL

The present invention concerns a cover channel, a cover frame comprising such a cover channel, an insulating panel comprising such a cover frame and an air handling unit comprising such an insulating panel, and a method for manufacturing such a cover channel.

It is known to implement air handling units on buildings, especially office buildings or supermarkets, for treating the air contained inside the building. Such handling units usually have inlet and outlet openings, for the air to be circulated through the unit, and a plurality of components, each relative to a function for treating the air, such as circulating, filtering, depolluting, humidifying, drying, heating, cooling, or the like. These components are enclosed inside a structural frame, supporting a housing made of flat insulating panels, forming a protective thermal barrier of the air handling unit. Each panel comprises an insulating core material, for example a glass-wool, interposed between two metallic walls. At least some of the panels of the unit are removable, or provided with handles, hinges or the like, so that they may be removed or opened for maintenance of the internal components contained within the unit. Usually, the panels are secured to the frame and/or to each other by means of fasteners such as screws, rivets or the like.

WO-A1-01/50068 discloses a one-piece extruded plastic channel configured to support two planar panels having a predetermined thickness in parallel spaced relationship, by receiving free edges of the panels therein. The channel includes an elongated body of U-shaped section, which includes a flat intermediate section and a pair of rigid outer walls, one of which extends from each of the lateral edges of the intermediate section. The U-shaped body further includes a pair of flexible inner walls, each of which extends from a junction with the intermediate section at a position adjacent to and spaced laterally inwardly from one of the outer walls. The channel is configured to be mounted on both planar panels, by insertion of the respective edges of the panels in between adjacent inner and outer walls.

However the known handling units are frequently subject to leakage of air, heat and humidity, especially at the outline of the panels or the inlet and outlet openings, despite the presence of plastic channels. In some cases leaking fluid may reach and harm the insulating core of the panels.

The aim of the invention is to provide a cover channel which may efficiently prevent fluid leakage at an edge of an insulating panel while being especially easy to mount onto said insulating panel.

To this end, the invention concerns a cover channel according to claim 1.

Thanks to the invention, the sealing gasket is brought in tight contact with at least one of the rim portions when the cover channel is mounted onto the edge, so that fluid leakage is prevented at the edge of the insulating panel, while the cover channel is easy to mount thereto.

Further optional and advantageous aspects of the invention are defined in claims 2 to 6.

The invention further relates to a cover frame according to claim 7.

Further optional and advantageous aspects of the invention are defined in claims 8 to 11.

The invention further relates to an insulating panel, according to claim 12, to an air handling unit, according to claim 13, and to a method for manufacturing according to claim 14.

The invention will now be explained in reference to the annexed drawings, as an illustrative example. In the annexed drawings.

Figure 1:
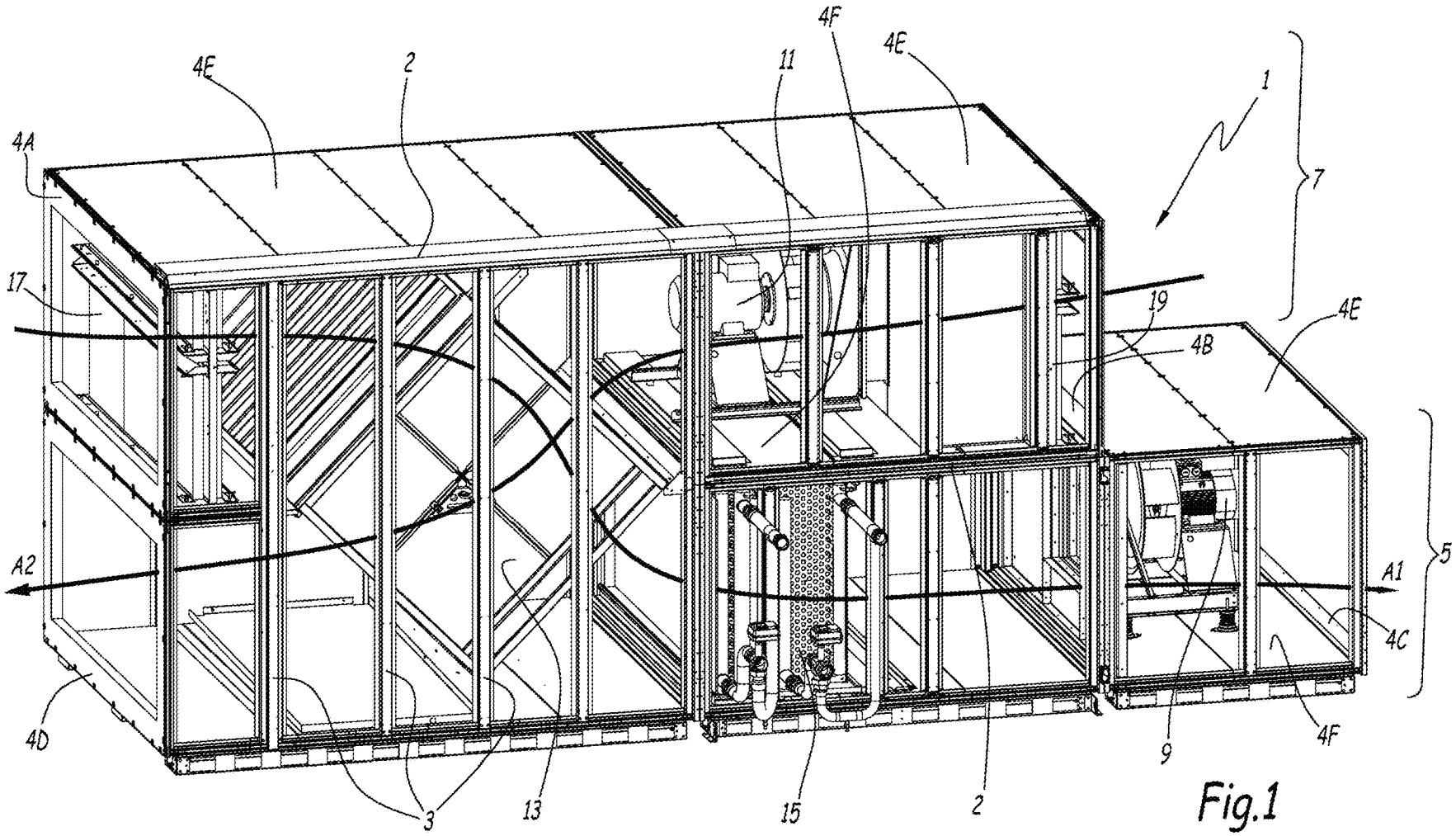
FIG. 1 is a perspective view of an air handling unit according to the invention.

FIG. 1 shows an air handling unit 1 which comprises structural frame including horizontal beams 2 and vertical beams 3. These beams 2 and 3 support a housing made of flat thermal insulating panels, of substantially rectangular shape. Some of these panels are omitted from FIG. 1 for making the inside of the housing visible. Some other panels 4A and 4B constitute inlet panels 4A and 4B. Some further panels constitute outlet panels 4C and 4D. Further panels constitute horizontal roof panels 4E and horizontal floor panels 4F.

The air handling unit 1 comprises two levels, namely a first level 5 and a second level 7 superposed over said first level 5. Level 7 is delimited at its ends by panels 4A and 4B, laterally by successive panels not shown in FIG. 1, at the top by roof panels 4E and at the bottom by floor panels 4F. Similarly, level 7 is delimited at its ends by panel 4C and 4D, the panel 4D being positioned in the same plane as panel 4A, while panel 4C is positioned in a plane parallel to the plane of panel 4B, at a distance of panel 4C. The distance between panels 4B and 4C covered by two roof panels 4E covering the top of level 5 between panel 4B and panel 4C. Successive lateral panels, not shown on FIG. 1, cover level 5 laterally, while the bottom of level 5 is delimited by floor panels 4F.

The air handling unit 1 includes several components, some of which are illustrated in FIG. 1. Among these components, this air handling unit 1 comprises a fan motor assembly 9 enclosed inside the housing at level 5, at the vicinity of panel 4C. The air handling unit 1 comprises a further fan motor assembly 11, enclosed at level 7 between panels 4A and 4B. The air handling unit 1 also has an air heat exchanger 13 provided across levels 5 and 7, between panel 4A and the fan motor assembly 114, and between panel 4D and the fan motor assembly 9. A first air flow A1 is circulated by means of fan motor assembly 9, the air flow A1 being admitted through inlet panel 4A, then passing through the exchanger 13 and through a thermodynamic machine 15 provided between the exchanger 13 and the fan motor assembly 9 at level 5. The air flow A1 then passes through the fan motor assembly 9 and exits the air handling unit 1 through the outlet panel 4C. The outlet panel 4C is advantageously connected to an air duct of a building, not shown, at the top of which the air handling unit 1 is installed. Alternatively, the air handling unit 1 may be installed in a basement of such a building, or in any other suitable part of the building.

The second air flow A2 is admitted through inlet panel 4B, and passes through the fan motor assembly 11, then the exchanger 13, where thermal energy is exchanged between the flows A1 and A2. The flow A2 is then directed to level 5 and exits the air handling unit 1 through outlet panel 4D. The inlet panel 4B is advantageously connected to an air duct of the building.

The air handling unit 1 is also provided with air filters 17 and 19 enclosed in the housing at the vicinity of inlet panels 4A and 4B.

Figure 4:
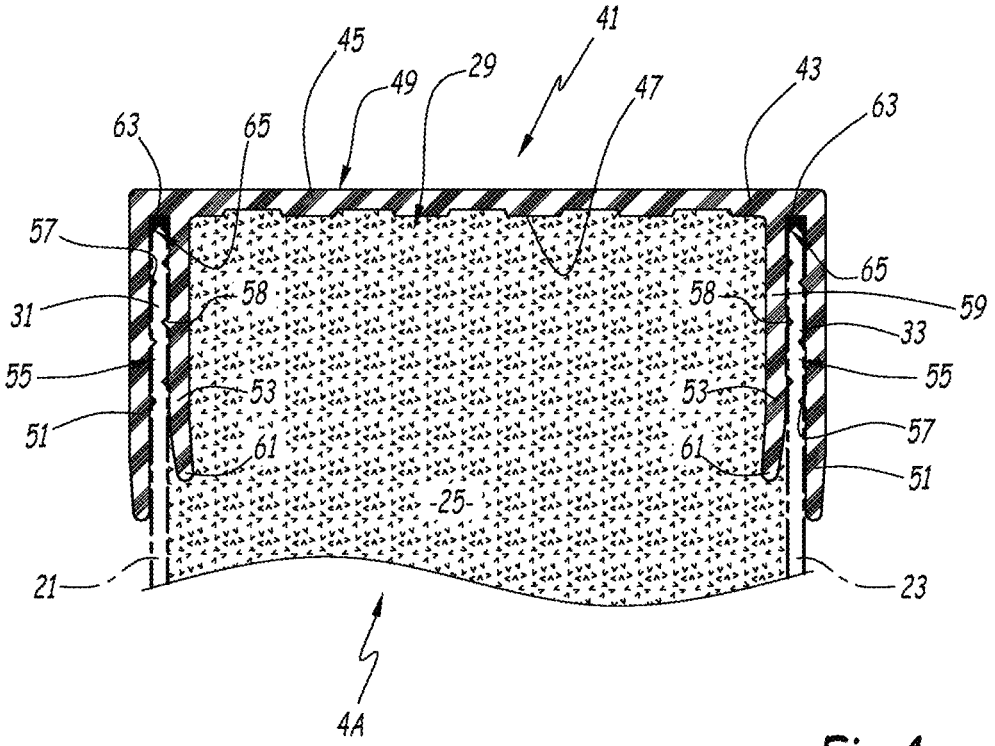
FIG. 4 is a partial cross-section of one of the cover channels mounted on the insulating panel of FIG. 2.

As it is illustrated in FIG. 4, each of the insulating panels 4A to 4F has two substantially parallel outer walls 21 and 23 made of a substantially rigid material such as aluminum alloy or plastic material. The panels 4A to 4F further comprise a thermal insulating material layer 25 interposed between said outer walls 21 and 23, such as glass-wool, insulating foam, or any other suitable material, to convey insulating properties to said panels 4A to 4F and limit heat transfer from one side of the panel to the other side. Thus, the panels 4A to 4F constitute a thermal barrier enclosing the components of the air handling unit 1, so that heat losses of the air flows A1 and A2 through the air handling unit 1 are limited. In addition, the panels 4A to 4F are secured to the beams 2 and 3 of the structural frame for forming a substantially airtight housing guiding the air flows A1 and A2.

Figure 2:
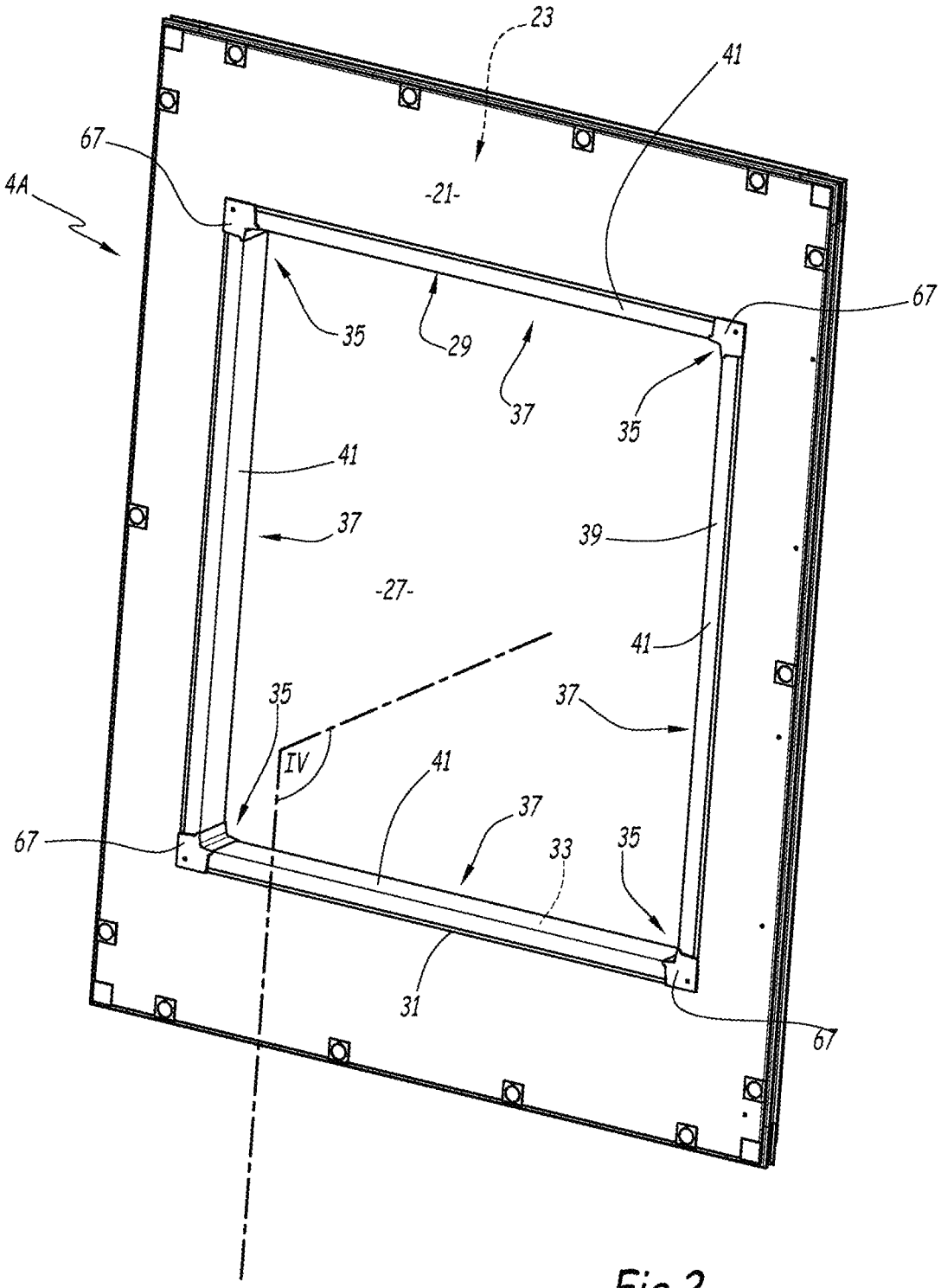
FIG. 2 is a perspective view of an insulating panel of the air handling unit of FIG. 1, provided with a cover frame according to the invention, including cover channels and cover corners.
Figure 3:
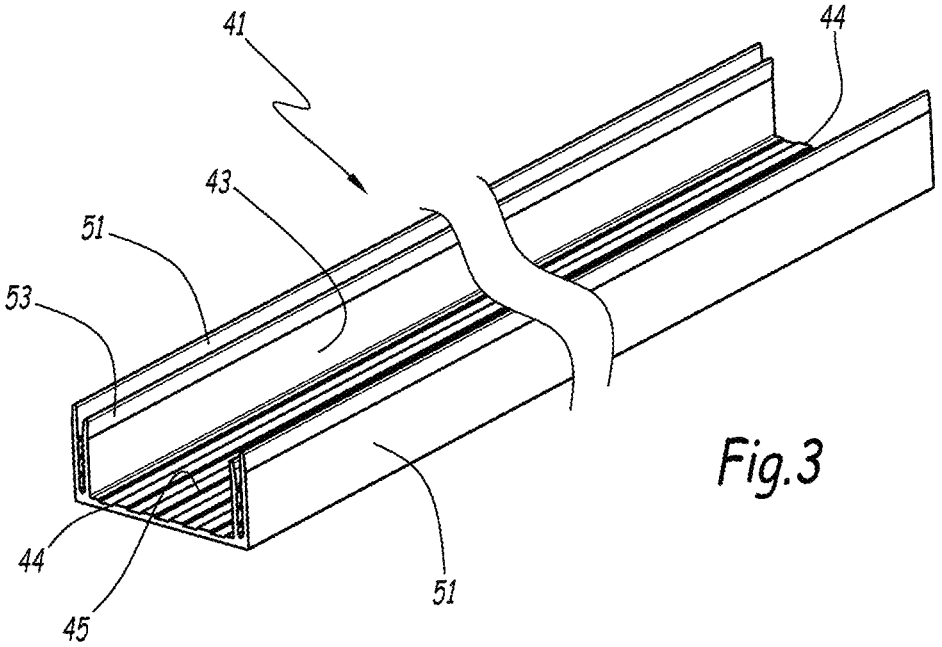
FIG. 3 is a perspective view of one of the cover channels of FIG. 2.

The panels 4E and 4F, as well as the lateral panels, are closed, while panels 4A, 4B, 4C and 4D are each provided with an opening 27, as illustrated for panel 4A in FIG. 2. Depending on which panel, the opening 27 may be used as an inlet or an outlet for one of the flows A1 or A2, through the concerned insulating panels 4A, 4B, 4C or 4D. The opening 27 may be connected to an air duct, provided with shutters, and/or any other component related to air admission or extraction. For each of said panel, the opening 27 defines a rectangular edge 29, defining the outline of the opening 27. Along this edge 29, each of the outer walls 21 and 23 define a rim portion numbered 31 and 33, respectively, of substantially rectangular shape as depicted in FIG. 3. As the shape of the opening 27 is rectangular, the edge 29, and the rim portions 31 and 33, comprise four edge corners 35 linked by four longitudinal portions 37.

The opening 27 is provided with a cover frame 39 covering the edge 29 of the opening 27. The cover frame 39 comprises four cover channels 41, each covering one of the longitudinal portions 37 of the edge 29.

The cover channel 41 comprises an elongated body 43, visible in particular on FIGS. 3 and 4, having with two longitudinal ends 44. This elongated body 43 has a cross-section, visible on FIG. 4, which is preferably constant from one end 44 to the other. The elongated body 43 is preferably a profile obtained by extruding a substantially rigid material such as an aluminum alloy or a plastic material from an end 44 to the other. Plastic material is preferred, since it has thermal insulating properties.

The elongated body 43 of the cover channel 41 comprises a cover portion 45 forming a substantially flat board for covering the open edge 29 and avoiding the insulating material 25 to flee through the longitudinal portions 37. The cover portion 45 extends in a plane perpendicular to the walls 21 and 23 when the cover channel 41 is mounted onto the longitudinal portion 37. The cover portion 45 is provided with reinforcing ribs 47 extending along the elongated body 43, and protruding towards the insulating material 25 when the cover channel 41 is mounted onto the edge 29. A face 49 of the cover portion 45 opposite to the reinforcing ribs 47 is preferably substantially flat.

The elongated body 43 further comprises two outer portions 51, protruding respectively from lateral edges of the cover portion 45, in a substantially perpendicular direction relative to the cover portion 45, in the same direction than the ribs 47. Thus, the cross-section of the elongated body 43 is U-shaped. The outer portions 51 form two lateral wings of the elongated body 43 configured to recover the rim portions 31 and 33 when the cover channel 41 is mounted onto the edge 29. Thus, the edge 29 is continuously recovered by the elongated body 43, from the rim portion 31 to the rim portion 33.

The elongated body 43 also comprises two clamping portions 53, each protruding from the cover portion alongside one of the outer portions 51. The clamping portions 53 are arranged between the outer portions 51 for covering inside faces of the rim portions 31 and 33, respectively. The clamping portions 53 form two longitudinal wings extending substantially parallel to the outer portions 51 and perpendicular to the cover portion 45. Each of the clamping portions 53 defines a clamping gap 55 with its adjacent outer portion 51. The two clamping gaps 55 each form a rail extending longitudinally and shaped to accommodate respective rim portions 31 and 33, all along one longitudinal portion 37 of the edge 29. Each of the clamping gaps 55 is sufficiently narrow so that each of the rim portions 31 and 33 is slightly squeezed between adjacent clamping portion 53 and outer portion 51, by slight elastic deformation of the material of the elongated body 43. Thus, the cover channel 41 is retained onto the edge 29.

The elongated body 43 comprises retaining ribs 57 and 58 protruding within the clamping gaps 55 for better retaining. In this example, as visible on FIG. 4, each of the outer portions 51 is provided with three retaining ribs 57 protruding towards the adjacent clamping portion 53. Three retaining ribs 58 are also provided on each clamping portion 53, and protrude towards the adjacent outer portion 51, at staggered locations relative to the ribs 57 of the outer portion 51. The retaining ribs 57 and 58 extend all along the elongated body 43.

For an easier clamping of the cover channel 41 onto the longitudinal portion 37 of the edge 29, the clamping portions 53 comprise an intermediate part 59 parallel to the adjacent outer portion 51 and an end part 61 of narrower thickness than the intermediate part 59. The end part 61 extends from the intermediate part 59 and is inclined away from the adjacent outer portion 51. In other words, each clamping gap 55 is sufficiently narrow at the base for an appropriate clamping of the rim portions 31 and 33, and slightly flaring at the open end, as depicted on FIG. 4. In addition, the clamping portions 53 are shorter than the outer portion 51 for easier mounting of the cover channel 41 onto the edge 29.

The cover channel 41 further comprises two sealing gaskets 63 provided along the elongated body 43, at the base of the clamping gaps 55. Each sealing gasket 63 rests against the cover portion 45, between adjacent outer portion 51 and clamping portion 53. Each sealing gasket 63 is provided with a longitudinal V-shaped groove 65 extending along the elongated body 43. Each of the grooves 65 is open towards the opening of the clamping gap 65 within which said groove 65 is provided, in the direction opposite to the cover portion 45. Each of the grooves 65 is configured to receive one of the rim portion 31 and 33 so that, when the cover channel 41 is clamped onto the edge 29, the sealing gaskets 63 are compressed between the rim portions 31 and 33 and the cover portion 45, thus ensuring tightness and protection of the inside of the concerned panel 4A, 4B, 4C or 4D.

The sealing gaskets 63 are made of a flexible material, such as an elastomer or any other suitable material, which can be extruded. Preferably, the elongated body 43 and the sealing gaskets 63 are coextruded together, so that the cover channel 41 is easy to manufacture.

Figure 5:
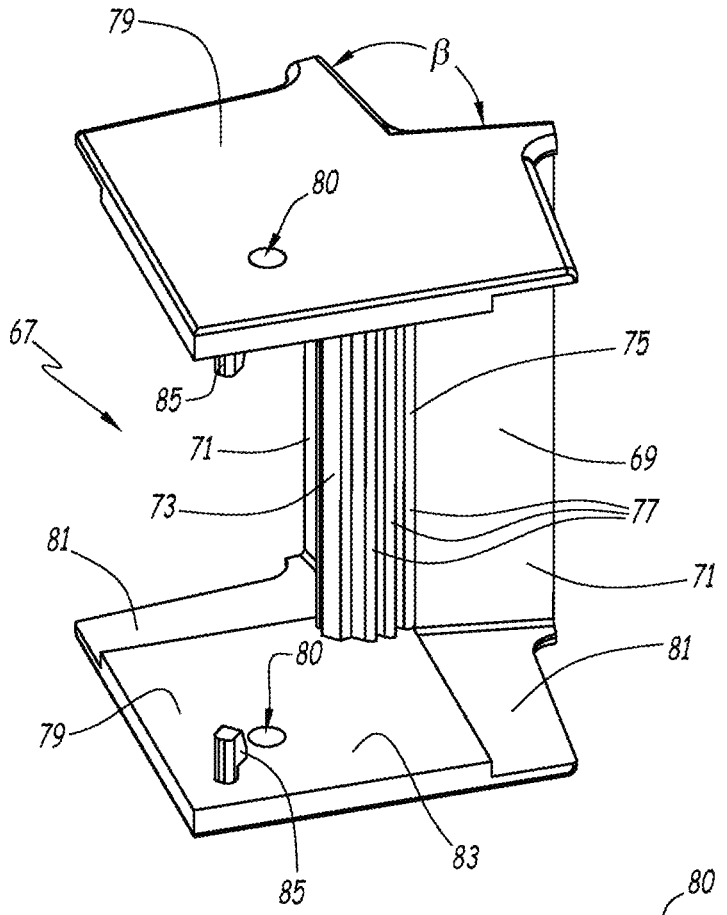
FIGS. 5 and 6 are two different perspective views of one of the cover corners of FIG. 2.
Figure 6:
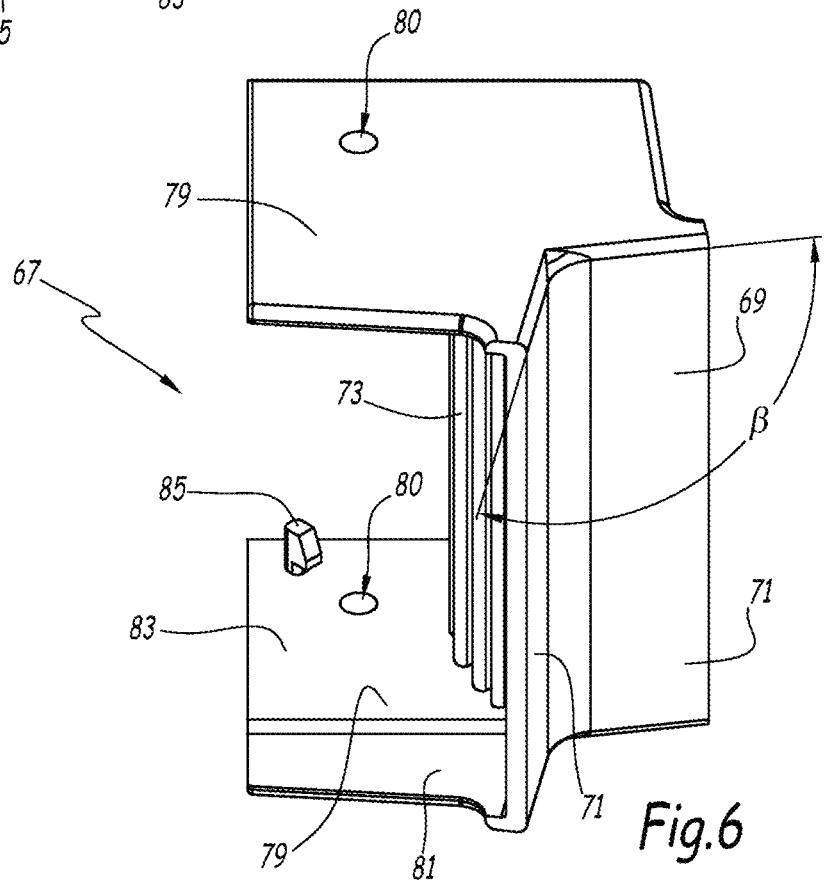

The cover frame 39 further comprises four cover corners 67, configured to be mounted onto the edge corners 35 of the opening 27, at the ends 44 of the cover channels 41, as visible on FIG. 2. One of these cover corners 67 is depicted independently on FIGS. 5 and 6. The cover corner 67 is made of an elastic material, preferably an elastomer, so as to be mounted onto the elongated body 43, made of a more rigid material than elastomer, by elastic deformation of the cover corner 67.

The cover corner 67 comprises a central corner part 69, provided with two opposite overlaying portions 71 extending along planes angled with an angle β. Each of the overlaying portions 71 is configured for partially overlaying one cover portion 45 of a respective cover channel 41. As visible on FIG. 2, each overlaying portion 71 covers one of the ends 44 of a cover channel 41, when the cover corner 67 is mounted thereto.

The cover corner 67 further has an anchor 73, protruding from a ridge 75 formed at the intersection of the overlaying portions 71, opposite the angle β. The anchor 73 is provided with two groups of successive fins 77, for example three successive fins 77, directed perpendicular to the ridge 75, the fins 77 of the two groups being oriented away from each other. The cover corner 67 may be mounted onto the end 44 by anchoring the fins 77 of the anchor 73 to the ends 44, the anchor being caught between the ends 44 of two adjacent cover channels 41.

As depicted on FIGS. 3 and 4, in the present example, the angle β equals 110° when the cover corner 67 is not mounted, in other words not deformed. When mounted onto the cover channels 41 by means of the anchor 73, the overlaying portions 71 are elastically deformed and pressed in an airtight manner onto the ends 44 of the two adjacent cover channels 41, so that that angle β becomes equal to approximately 90°. Alternatively, the angle β can be chosen to be equal to a value of 95° or more when the cover corner 67 is not deformed.

The cover corner 67 is also provided with two planar cover wings 79, substantially parallel to each other when the cover corner 67 is not deformed. Each of the cover wings 79 protrudes from one edge of the corner part 69 in a similar direction, opposite the angle β. Thus, the anchor 73 is formed between the cover wings 79. As depicted on FIG. 2, the cover wings 79 are configured to recover the outer portions 51 of two adjacent cover channels 41, at the ends 44 thereof, and to recover one of the edge corners 35. In particular, each cover wing 79 has two overlaying portions 81, oriented inwards, for partially overlaying one of the outer portions 51 at on of the ends 44, when the cover corner 67 is mounted thereto. Facing overlaying portions 81 of the two cover wings 79 are linked by the overlaying portion 71 of the corner part 69 for forming a continuous U-shaped overlaying portion for recovering the end 44 of one of the cover channels 41. The two opposite overlaying portions 81 of each cover wing 79 are linked by a central corner portion 83, connected to an end of the anchor 73. The central corner portion 83 is configured to recover and be in tight contact with the rim portion 31 or 33 of the one of the outer walls 21 or 23.

Each of the cover wings 79 comprises a hook 85, or any other suitable fastening means, for being secured to one of the outer walls. Each hook 85 protrudes from the central corner part 83 of the concerned cover wing 79, in a direction oriented inwardly. The hooks 85 are adapted for being anchored to corresponding holes, not visible on the figures, of the outer wall 21 and 23.

Optionally, a through hole 80 is provided in each cover wing 79, for centering and/or mounting a component onto the opening 27, such as a damper, not illustrated.

The cover corner 67 being elastically deformable, the cover wings 79 can be elastically deformed away from each other for allowing positioning of the cover corner 67 onto the ends 44. Once the anchor 73 is forcibly inserted and retained between the ends 44 of the two adjacent cover channels 41, the cover wings 79 may be folded back onto the respective outer walls 21 and 23, and the hooks 85 secured thereto. The hooks are preferably configured to ensure tight contact of the cover wings 79 onto said outer walls 21 and 23 and onto the outer portions 51 of the adjacent cover channels 41.

Thus, the cover frame 39 constitutes tight protection means of the edge 29 of the opening 27.

In a non-illustrated alternative, the cover channels 41 may be secured to a peripheral or lateral edge of any insulating panel similar to the panels 4A to 4F disclosed hereinabove.

The aforementioned embodiments and features of the invention may be combined for generating further embodiments of the invention.

The invention claimed is:

1. A cover channel, configured for covering an edge of an insulating panel, the insulating panel comprising two substantially parallel outer walls, the cover channel comprising an elongated body comprising:

a cover portion, two outer portions, protruding respectively from an edge of said cover portion in a substantially perpendicular direction relative to the cover portion, and two clamping portions, each protruding from the cover portion alongside one of the outer portions, each of the clamping portions defining a clamping gap with the adjacent outer portion, each of the clamping gaps being shaped to accommodate a rim portion of one of the two outer walls extending along the edge of the insulating panel, so that each of the rim portions is clamped between adjacent clamping portion and outer portion, wherein the cover channel further comprises at least one sealing gasket provided along the elongated body, resting against the cover portion within at least one of the clamping gaps;

wherein the sealing gasket is provided with a groove extending along the elongated body, said groove being opened in a direction opposite the cover portion.

2. The cover channel according to claim 1, wherein two sealing gaskets are provided along the elongated body, each of the sealing gaskets resting against the cover portion within one of the clamping gaps.

3. The cover channel according to claim 1, wherein the elongated body comprises retaining ribs protruding within the clamping gaps from at least one of the outer portions and/or the clamping portions.

4. The cover channel according to claim 1, wherein the cover channel is provided with at least one reinforcing rib protruding from the cover portion in the same direction than the outer portions.

5. The cover channel according to claim 1, wherein each of the clamping portions comprises an intermediate part, parallel to the adjacent outer portion, and an end part, extending from the intermediate part and being inclined away from said adjacent outer portion.

6. A cover frame, configured for covering an edge of an opening of provided through an insulating panel, the insulating panel comprising two substantially parallel outer walls, the cover frame comprising:

at least one cover channel according to claim 1 for covering a longitudinal portion of the edge, and at least one cover corner configured to be mounted onto a longitudinal end of the elongated body, at an edge corner of the edge, the cover corner comprising:

a corner part, including at least one overlaying portion for partially overlaying the cover portion at the longitudinal end of the elongated body, when the cover corner is mounted thereto, and two cover wings, each of the cover wings protruding from one edge of the corner part in a similar direction, each of the cover wings comprising an overlaying portion for partially overlaying one of the outer portions at the longitudinal end of the elongated body, when the cover corner is mounted thereto.

7. The cover frame according to claim 6, wherein the corner part is provided with two opposite overlaying portions extending along planes angled at 95° or more, when the cover corner is not mounted onto the cover channel.

8. The cover frame according to claim 6, wherein each of the cover wings comprises a fastening means secured to one of the outer walls, the fastening means protruding inwardly from the cover wings.

9. The cover frame according to claim 6, wherein the cover corner comprises an anchor, protruding from the corner part between the cover wings, and wherein the cover corner is mounted onto the longitudinal end of the elongated body by anchoring said anchor thereto.

10. The cover frame according to claim 6, wherein the cover corner is made of an elastomer and wherein the elongated body is made of a more rigid material than said elastomer.

11. An insulating panel comprising two substantially parallel outer walls and insulating material interposed therebetween, an opening being provided through the insulating panel, the opening defining an edge of the insulating panel, each of the outer walls defining a rim portion along said edge, the insulating panel comprising a cover frame according to claim 6, the cover channel covering a longitudinal portion of the edge and the cover corner being mounted onto the longitudinal end of the elongated body at a corner of the edge.

12. An air handling unit comprising at least one insulating panel according to claim 11.

13. A method for manufacturing the cover channel according to claim 1, wherein the elongated body and the sealing gasket are coextruded.

* * * * *